US006606998B1

(12) United States Patent
Gold

(10) Patent No.: US 6,606,998 B1
(45) Date of Patent: Aug. 19, 2003

(54) SIMPLE SIMULATED CIGARETTE

(76) Inventor: Ely Gold, 23679 Calabasas Rd., Suite 216, Calabasas, CA (US) 91302

( * ) Notice: Subject to any disclaimer, the term of this patent is extended or adjusted under 35 U.S.C. 154(b) by 12 days.

(21) Appl. No.: 09/971,864

(22) Filed: Oct. 5, 2001

(51) Int. Cl.[7] ..... A24F 47/00

(52) U.S. Cl. ..... 131/273; 131/271; 131/270; 131/274; 128/202.21

(58) Field of Search ..... 131/273, 271, 131/270, 274, 276; 128/202.21

(56) References Cited

U.S. PATENT DOCUMENTS 2,860,638 A * 11/1958 Bartolomeo ..... 128/201
3,631,856 A * 1/1972 Taylor ..... 128/203
4,429,703 A * 2/1984 Haber ..... 131/273
4,580,581 A * 4/1986 Reece et al. ..... 131/231
4,765,348 A * 8/1988 Honeycutt ..... 131/273
5,865,186 A * 2/1999 Volsey, II ..... 131/194
5,893,371 A * 4/1999 Rose et al. ..... 131/270

FOREIGN PATENT DOCUMENTS

GB 2266222 * 10/1993

* cited by examiner

*Primary Examiner*—Steven P. Griffin
*Assistant Examiner*—Dionne A. Walls

(57) ABSTRACT

A simulated cigarette with a cylindrical plastic chamber that has a cap on one side and a semi-flattened mouthpiece on the othe. The cap has an open-air inlet in the center of it and the mouthpiece has an open-air outlet at its end. The invention only has two parts comprising it, the cap and the chamber. When the user covers the mouthpiece part of the chamber with his/her mouth and inhales through the mouth a suction will be produced inside the chamber and air will be pulled in, through the open-air inlet (the cap), into the chamber and out through the open-air outlet inside the mouth. Fragrance will be added to the air that goes through the device.

1 Claim, 1 Drawing Sheet

SIMPLE SIMULATED CIGARETTE

BACKGROUND OF THE INVENTION

1. Field of Invention

This invention is similar in appearance to a cigarette. It contains no harmful chemicals, no tobacco, no nicotine, and does not only replace the average carcinogenic cigarette. In contrast it makes quitting the harmful and destructive habit much easier.

2. Description of Prior Art

Every year more than 400,000 Americans and about 3 million people worldwide die from smoking related diseases. After realizing that there is a direct correlation between smoking cigarettes (containing tobacco) and death, our society has chosen to break the strong grasp that cigarettes have on their victims/users by inventing many forms of possible remedies. Some of these likely remedies are hypnotism, gum containing nicotine, lozenges, seminars, patches that deliver nicotine (through the skin) into the bloodstream, and nicotine containing plastic simulated cigarettes. These alternatives can get very expensive and are in no way guaranteed to stop anybody from smoking. Evidently, the cigarette habit is more than just a physical need for a substance known as nicotine. Among smokers, there is a psychological need to hold a white cylindrical object, bring it to the mouth, suck slowly and deeply on it, hold it between the lips, and take it away from the mouth. Therefore, many inventions have been made to simply mimic the appearance and function of a cigarette with elements like fragrance instead of harmful substances such as nicotine and tobacco. These inventions are far from perfect. They have a complicated construction with many chambers, walls, filters, holes, and/or wicks. Inherent problems to these simulated cigarettes are that they are expensive to manufacture because of all the complex and intricate parts that comprise them and with more and more complicated parts put into them they do not become anymore beneficial to their users.

Not only are some of these previously mentioned devices complicated, but some have unnecessary chemicals in them. For example, the Volsey, II, Jack J., U.S. Pat. No. 5,865,186 issued on Feb. 2, 1999 uses an exothermic chemical reaction to heat a vapor which passes through an element from where the heated vapor gets its flavoring and then through a one-way valve it is expelled through the mouthpiece.

In the Taylor, Harold V., U.S. Pat. No. 3,631,856 a device is disclosed with a special container of pressurized oxygen in a tube-like outer layer. A valve (that is operated by orally exerted pressure) releases this oxygen into a mixing chamber, where the oxygen is mixed with air and flavorful, and fragrant filler. The mixture is then passed to the mouth of the user.

In the Honeycutt, Rufus H., U.S. Pat. No. 4,765,348, issued on Aug. 23, 1988 there are two air permeable materials. The one located inside the hollow tube across a segment of the transverse cross-sectional area of the tube is impregnated with a nicotine free base material and the second is impregnated with an acid. When this acid and base react, a salt with a pH level of about 5 to 7 is formed.

BRIEF SUMMARY OF THE INVENTION

In the present invention simplicity is paramount. There are only two parts: a chamber and a cap for this chamber. Due to this invention's lack of unnecessary and excessive parts, many chambers, and chemicals many previously discussed drawbacks are precluded. This invention looks a lot more like a real cigarette than most bulky and crude devices with chambers and barriers and chemicals and valves going every which way. The price of this invention is radically less than similar looking devices that perform the exact same purpose. Since there are only two parts comprising this unique invention can be produced very easily and quickly. Most importantly, simplicity in design lets the flavoring, contained in the invention, be easily changed at the user's discretion. This simulated cigarette looks very sleek and is very user-friendly.

BRIEF DESCRIPTION OF THE SEVERAL VIEWS OF THE DRAWINGS

A better understanding of the present invention will become apparent from reading the following detailed description of the preferred embodiment along with the accompanying drawings in which.

DETAILED DESCRIPTION OF THE INVENTION

Figure 1:
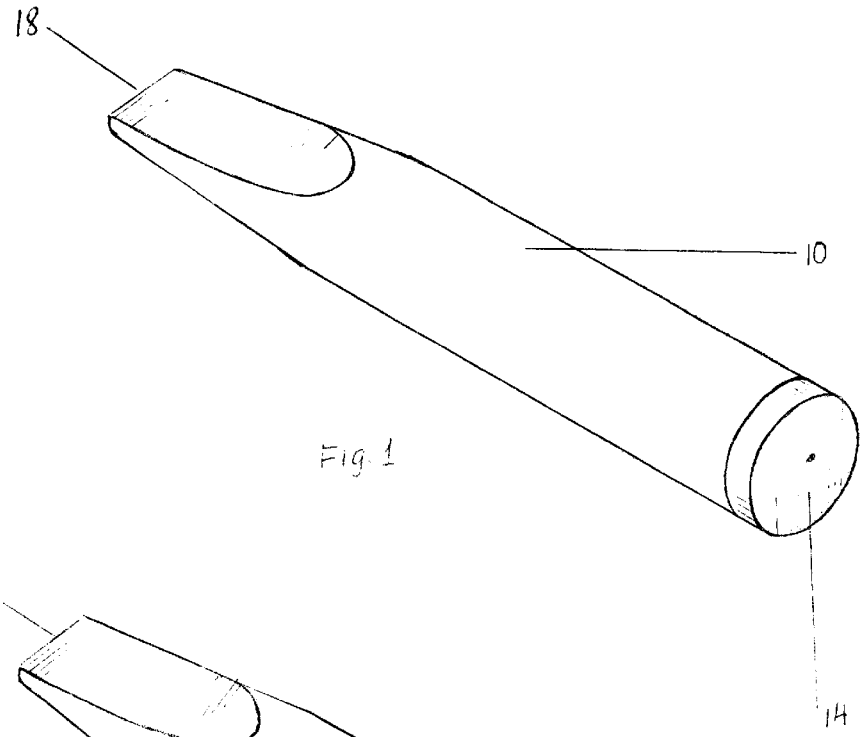
FIG. 1 is a perspective view of a simulated cigarette inhaler device of the present invention.
Figure 2:
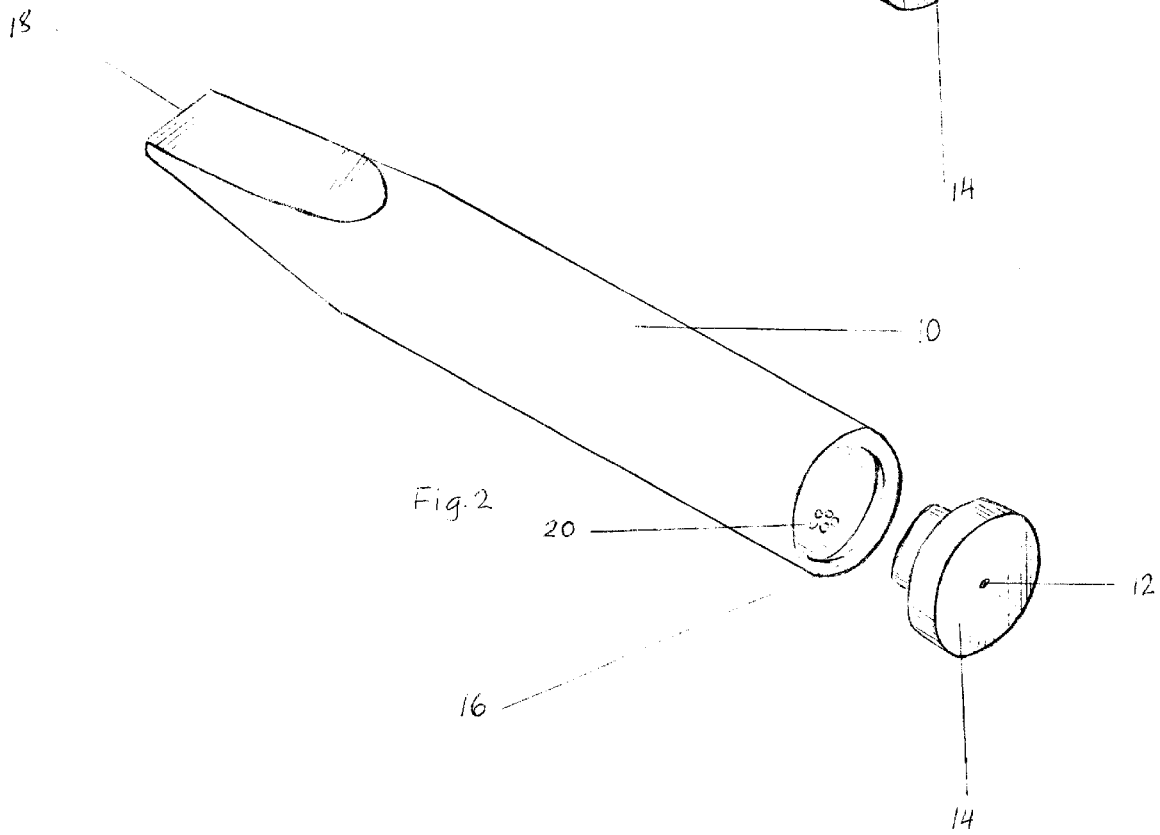
FIG. 2 is a exploded perspective view, with parts broken away of the simulated cigarette inhaler device according to FIG. 1.

With reference to FIG. 1 and FIG. 2 there is shown a simulated cigarette inhaler comprising of two parts: a hollow cylindrical plastic chamber denoted as numeral 10 semi-flattened into the form of a mouthpiece at the end with an open-air outlet denoted as numeral 18 and a cap denoted as numeral 14 with an open-air inlet in the center of it denoted as numeral 12. In use, the user puts the mouthpiece tip with the open-air outlet 18 into his mouth and inhales to draw air through chamber 10. The inhaler contains a fragrance concentrate that occupies the said inhaler in any of three possible ways:

1. The main chamber 10 is made out of a mixture of any pleasant fragrance concentrate with LDPE, LLDPE (Low Density Polyethylene) and HDPE (High Density Polyethylene) resins in varying percentages. The percentages vary from 10 to 90 percent fragrance concentrate and 90 to 10 percent LDPE, LLDPE or HDPE resin. These percentages depend on how long I want the pleasant flavor to last. The less fragrance concentrate inside the chamber 10, the sooner the flavorful taste and smell will die out. Varying the percentage of fragrance concentrate is crucial in determining the length of time we want the user to continue using the invention. The enjoyable flavoring can last between 10 to 300 days depending on my discretion. The cap 14 fits inside the main chamber 10 and can be made out of any type of general purpose plastic. When the user inhales the suction in the chamber 10 will force air in through the open-air inlet (the cap) 12 and into the chamber 10 where the air will absorb the pleasant flavoring from the walls of the chamber 10. The mixture of air and fragrance will be pushed out through the open-air outlet in mouthpiece tip 18 and into the mouth of the user.
2. The main chamber 10 can be comprised from any type of general purpose plastic, while the cap 14 has to consist of up to 100% fragrance concentrate. When the user inhales the suction in the chamber 10 will force air in through the open-air inlet (the cap) 12. When the air passes through the hole 12 in the cap 14 it will absorb the pleasant flavoring from the cap 14. The mixture of air and fragrance will be pushed out through the main chamber 10 and the open-air outlet in mouthpiece tip 18 and into the mouth of the user. In this case, the pleasant flavoring will not last as long as it will in case 1.

3. The main chamber 10 and the cap 14 can be produced from any type of general purpose plastic. The fragrance concentrate is contained inside of the main chamber 10 in the form of pellets denoted as numeral 20. These fragrance concentrate pellets can vary from 1 to 5 in number. The variation in amount of the number of pellets depends on the discretion of the user. If the user wants a strong long-lasting flavor a high number of pellets 20 should be put inside the chamber. When the user inhales the suction in the chamber 10 will force air in through the open-air inlet (the cap) 12 and into the chamber 10 where the air will absorb the pleasant flavoring from the pellet(s) 20 inside the chamber 10. The mixture of air and fragrance will be pushed out through the open-air outlet in mouthpiece tip 18 and into the mouth of the user. In all three cases, the same fragrance concentrate is comprised of an LDPE co-polymer base resin designed to carry high loads of fragrance. These loads of fragrance range from 10 to 25 percent.

What I claim as my invention to be protected by the United States Patent and Trademark Office is:

1. A simulated cigarette inhaler comprising:

a hollow cylindrical chamber, having a proximal and distal end, with an open-air outlet which is semi-flattened into the form of a mouthpiece at the proximal end, and a cap, with an open-air inlet in the center of it, inserted into the chamber at the distal end, further comprising an aroma concentrate that is absorbed by air moving through the inhaler, wherein said chamber is fabricated from a mixture of a synthetic resin and said aroma concentrate.

* * * * *